US005663694A

United States Patent [19]

Goebel et al.

[11] Patent Number: 5,663,694

[45] Date of Patent: Sep. 2, 1997

[54] TRIGGERED-PLASMA MICROWAVE SWITCH AND METHOD

[75] Inventors: Dan M. Goebel, Tarzana; Joseph Santoru, Agoura Hills; Robert L. Poeschel, Thousand Oaks; John W. Gerstenberg, Lake Elsinore, all of Calif.

[73] Assignee: Hughes Electronics, Los Angeles, Calif.

[21] Appl. No.: 612,988

[22] Filed: Mar. 8, 1996

[51] Int. Cl.[6] ..... H01P 1/185; H01P 1/14; H01P 1/28

[52] U.S. Cl. ..... 333/157; 331/82; 333/101; 333/253; 333/258; 333/99 PL

[58] Field of Search ..... 333/101, 13, 157, 333/159–161, 164, 253, 258, 263, 99 PL

[56] References Cited

U.S. PATENT DOCUMENTS

| | | | |
|---|---|---|---|
| 3,023,380 | 2/1962 | Hill | 333/13 |
| 3,208,068 | 9/1965 | Hoffman | 333/253 X |
| 3,281,719 | 10/1966 | Goldberg | 333/101 |
| 3,611,008 | 10/1971 | Anderson et al. | 315/39 |
| 3,621,481 | 11/1971 | Perreault | 333/159 |
| 3,903,489 | 9/1975 | Schubert | 333/258 |
| 4,450,419 | 5/1984 | Schwarzmann | 333/164 |
| 4,843,358 | 6/1989 | Meise et al. | 333/263 |

*Primary Examiner*—Paul Gensler
*Attorney, Agent, or Firm*—Vijayalakshmi Duraiswamy; Wanda K. Denson-Low

[57] ABSTRACT

A microwave switch selectively directs a microwave signal along first and second signal paths. The switch includes a microwave transmission member, a microwave chamber formed by the transmission member for containing an ionizable gas, input and output ports formed by the transmission member to communicate with the microwave chamber and a triggered plasma generator which is configured to generate, in response to a voltage trigger signal, a trigger electron density $N_t$ in the gas. The microwave signal increases the trigger electron density $N_t$ to a reflective electron density $N_r$. Consequently, the microwave signal is reflected along a first path from the input port when the trigger electron density $N_t$ is present and is directed along a second path to the output port when the trigger electron density $N_t$ is absent. A plurality of these microwave switches is arranged to form a tunable microwave short.

36 Claims, 5 Drawing Sheets

TRIGGERED-PLASMA MICROWAVE SWITCH AND METHOD

BACKGROUND OF THE INVENTION

1. Field of the Invention

The present invention relates generally to high-power microwave switches.

2. Description of the Related Art

Microwave switches typically transition between a transmissive state and a reflective state in response to a control parameter. The choice of control parameter is related to the intended use of the microwave switch.

For example, transmit/receive (T/R) switches are typically used in radar systems to protect a radar receiver from reflected signals of high-power transmitter pulses. In this application, it is imperative that the control parameter is the reflected pulse itself. Thus, T/R switches are generally designed to change from their transmissive state to their reflective state in response to an incident microwave signal that exceeds a predetermined threshold.

In contrast, a microwave switch for directing microwave signals in a microwave network must respond to an external trigger signal. Preferably, a triggered microwave switch for network use exhibits a low insertion loss in its transmissive state, reflects a signal having high phase stability when in its reflective state and transitions quickly between the two states.

Although prior work on triggered microwave switches has not been as extensive as the work on T/R-type switches, a variety of triggered switches have been developed. For example, U.S. Pat. No. 3,611,008 discloses an exemplary triggered waveguide switch which includes a pair of main electrodes and a trigger electrode. The main electrodes are composed of a low vapor pressure metal, e.g., copper, and are separated to form an electrode gap. The main electrodes are either positioned within an evacuated waveguide section or within a chamber that communicates with the waveguide section. The material of the trigger electrode, e.g., titanium hydride, contains a stored gas, e.g., hydrogen, and the trigger electrode is spaced from one of the main electrodes.

In operation, a potential is placed across the main electrodes and a voltage pulse applied to the trigger electrode. The pulse initiates a spark whose discharge energy releases and ionizes a portion of the stored gas. This reduces the dielectric strength in the main-electrode gap which induces an arc between the main electrodes. Metal ions are boiled off the electrodes and ionized to form a plasma which fills the waveguide section and reflects incident microwave signals. The plasma will be maintained as long as the main electrode potential is sustained. Unfortunately, the metal vapor tends to collect on the waveguide windows which increases the insertion loss of the waveguide switch when it is in its transmissive state. Although this problem can be reduced by introducing waveguide septums to block the flow of metal ions to the waveguide windows, the septums also increase the switch's insertion loss.

Another exemplary triggered microwave switch is described in U.S. Pat. No. 3,903,489. This switch has a waveguide section which is filled with a low-pressure controlled atmosphere which is suitable for supporting a glow discharge. A plasma generator includes an anode and a control grid which form opposite sides of the waveguide section but are electrically isolated from the remainder of the waveguide. This arrangement concentrates the anode's electric field in the waveguide section so that most of the field is available to accelerate electrons which reach the vicinity of the control grid. In operation, a high-density plasma is injected into the waveguide section by the anode's electric field. This places the waveguide section in a high insertion loss state so that an incident microwave signal is substantially reflected. The plasma is triggered by a trigger pulse which is applied between the control grid and the anode. The power to keep the waveguide section in its high insertion loss state is supplied by the plasma generator.

As shown by these examples, triggered microwave switches have been developed but they are typically complex (e.g., U.S. Pat. No. 3,611,008 describes main electrodes, a trigger electrode and isolating septums and U.S. Pat. No. 3,903,489 describe heater, cathode, control grid, anode and focusing structures), have elements which typically have a short lifetime (e.g., the low vapor pressure electrodes of U.S. Pat. No. 3,611,008 and the heater of U.S. Pat. No. 3,903,489) and require significant input power (e.g., the main electrode potential of U.S. Pat. No. 3,611,008 and the plasma generator of U.S. Pat. No. 3,903,489).

SUMMARY OF THE INVENTION

The present invention is directed to a simple, fast, inexpensive, triggered microwave switch which is especially suited for controlling the propagation path of high-power microwave signals. In particular, a microwave switch which can be switched with a low-energy trigger pulse (e.g., <0.1 Joule) at rates well in excess of 100 Hz and whose elements are not consumed by the switching process nor deposited on other switch elements, e.g., vacuum windows, to degrade the switch's performance.

These goals are achieved with the realization that a high-power microwave signal which is incident upon an ionizable gas will generate a high-density plasma in that gas if sufficient seed electrons are present in the gas. In contrast, no plasma will be generated by the microwave signal in the absence of seed electrons. Thus, the microwave signal can be directed along different signal paths by controlling the presence of seed electrons in an ionizable gas. It is further realized hat the pressure of the ionizable gas can be adjusted to facilitate additional plasma generation from the seed electrons by the incident microwave signal.

On triggerable microwave switch embodiment includes a microwave transmission member which has a microwave chamber for containing an ionizable gas, input and output ports that communicate with the microwave chamber and a triggered plasma generator. The triggered plasma generator is configured to generate, in response to a voltage trigger signal, a trigger electron density $N_t$ wherein this density is representative of the presence of sufficient seed electrons. The incident microwave signal increases the trigger electron density $N_t$ to a reflective electron density $N_r$. Thus, the microwave signal is reflected along a first path from the input port when the trigger electron density $N_t$ is present and is directed along a second path to the output port when the trigger electron density $N_t$ is absent.

The triggered plasma generator can include an electrode extending into the microwave chamber and arranged to receive the voltage trigger signal. The electrode is preferably formed of a refractory metal and preferably has a diameter <600 microns. Another triggered plasma generator is configured to couple electromagnetic radiation into the microwave chamber so that a radiation portion (e.g., an ultraviolet portion) photoionizes the gas in the chamber.

A plurality of triggered microwave switches of the invention can be used to form a tunable short. In a tunable short, an entrance port is formed by the input port of a first switch and all switches are connected in series so that the input ports of the other switches are each spaced by a different path length from the first switch. Selective application of a trigger signal to different ones of the switches causes a microwave signal received at the entrance port to travel different path lengths as it is reflected back to the entrance port.

The novel features of the invention are set forth with particularity in the appended claims. The invention will be best understood from the following description when read in conjunction with the accompanying drawings.

DETAILED DESCRIPTION OF THE PREFERRED EMBODIMENTS

Figure 1:
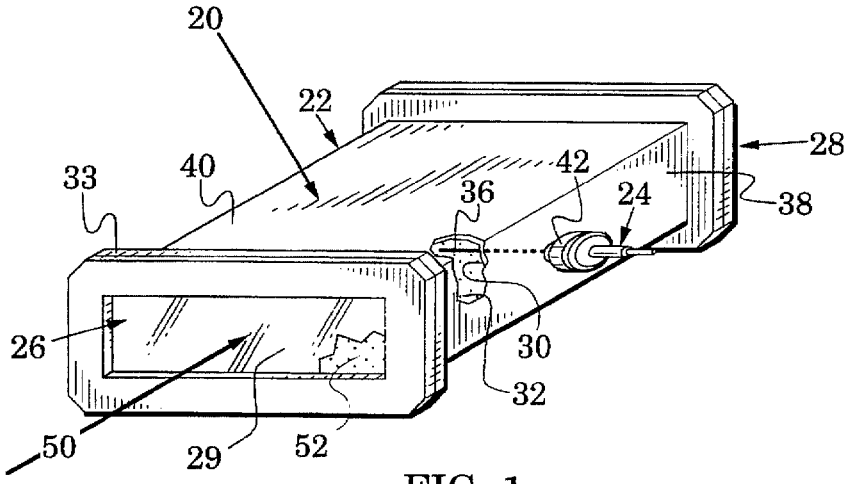
FIG. 1 is a perspective view of a triggered-plasma microwave switch in accordance with the present invention.
Figure 2:
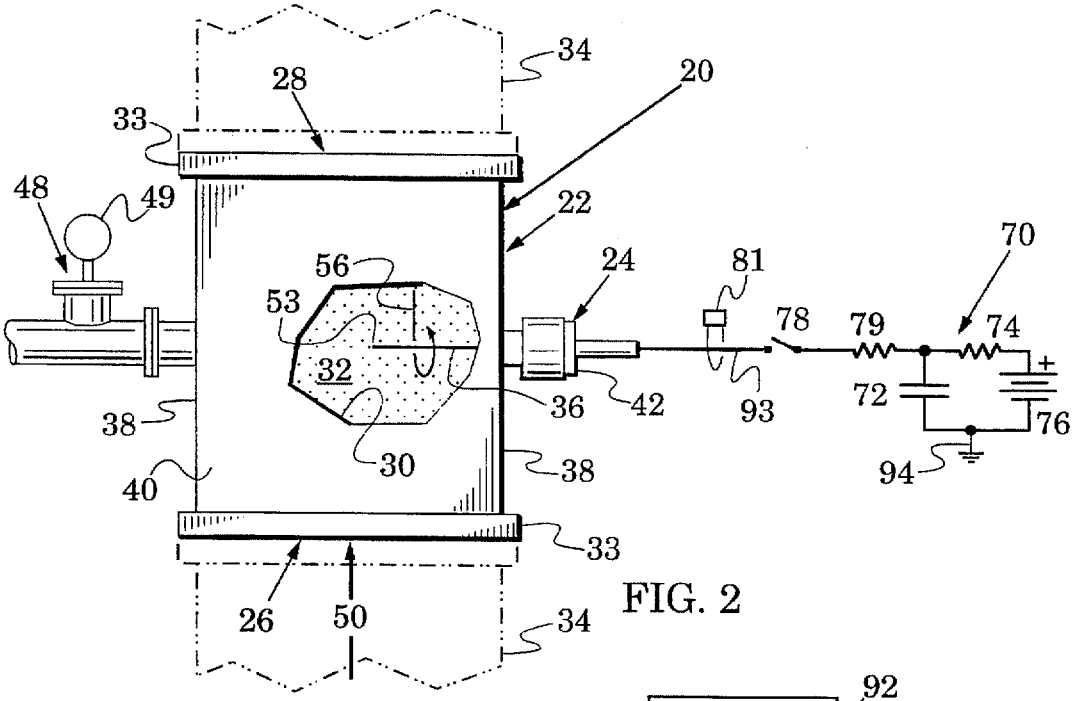
FIG. 2 is a plan view of a microwave switch system which includes the triggered-plasma microwave switch of FIG. 1.

A triggered-plasma microwave switch 20 for directing a microwave signal along selected signal paths is shown in FIGS. 1 and 2. The switch 20 includes a microwave transmission member in the form of a rectangular waveguide 22 and a triggered plasma generator 24. The transmission member 22 has opposed ends which respectively form an input port 26 and an output port 28. At each port, the transmission member 22 is sealed with a vacuum window 29 that is formed of a material, e.g., pyrex or quartz, whose operational parameters include low microwave loss, low dielectric constant, good mechanical strength and excellent vacuum sealing capability.

With the aid of the vacuum windows 29, the transmission member 22 forms a microwave chamber 30 for containing an ionizable gas 32, e.g., hydrogen, helium or argon, and the ports 26 and 28 communicate with the chamber 30. Flanges 33 are positioned at each port to facilitate installation of the vacuum windows 29 and connection of the switch 20 with transmission members, e.g., the members 34 shown in broken lines in FIG. 2, of a microwave system.

The triggered plasma generator 24 includes an electrode 36 which extends into the chamber 30. Because the electric field of a microwave signal propagating through the transmission member 22 is typically parallel with the transmission member's narrow walls 38, the electrode 36 is preferably arranged parallel to the transmission member's broad walls 40 so as to reduce its perturbation effect on the microwave signal. The electrode 36 preferably has a small cross section, e.g., ~250 microns in diameter, to facilitate its triggered-plasma function and is formed of a refractory metal, e.g., tungsten, to enhance its heat resistance. It is electrically isolated from the narrow wall 38 by a bushing 42 formed of a high-voltage insulator, e.g., a ceramic.

The chamber 30 can be evacuated and filled with the ionizable gas 32 in any conventional manner. For example, a vacuum pump (not shown) can be connected to the chamber 30 through a pump-out port 48 that communicates with the chamber through a small aperture in one of the transmission member's narrow walls 38. The pump-out port 48 is equipped with a pressure gauge 49 and connects to a vacuum valve (not shown).

After evacuation, the chamber 30 can be conventionally filled to a predetermined pressure with a selected ionizable gas. The equilibrium gas pressure is determined by the gas inlet rate and the gas pumping rate which is controlled by using a vacuum valve to throttle the gas flow out of the chamber 30. This arrangement permits a small gas volume to be continuously pumped from the chamber 30.

Alternatively, this active pumping system can be replaced with a simple, conventional thermionic gas reservoir (not shown) which is coupled to the chamber 30. If the selected gas is hydrogen, for example, a zirconium-aluminum thermionic reservoir can be used. Before use, the reservoir is processed to absorb hydrogen atoms. After its installation in the switch 20, the emittance rate of hydrogen atoms is functionally related to the temperature to which the reservoir is heated.

In operation, the triggered-plasma microwave switch 20 is responsive to a triggered signal applied to its triggered plasma generator 24. In the absence of the trigger signal, the switch 20 will transmit an incident microwave signal 50 (shown in FIGS. 1 and 2) from the switch's input port 26 to the switch's output port 28. In the presence of the trigger signal, the switch 20 will reflect the incident microwave signal 50 from the switch's input port 26. A more detailed operational description of the triggered-plasma microwave switch 20 will be enhanced by preceding it with the following description of the relationship between the microwave cutoff frequencies in the switch 20 and the density of a plasma which is formed by ionization of the ionizable gas 32.

When the microwave signal 50 with an angular frequency $\omega$ is received into the input port 26 of the transmission member 22 and the transmission member is filled with a plasma, the signal's propagation can be described by the well known dispersion equation for the collisionless plasma of $$\omega^2=\omega_c^2+\omega_p^2+k^2c^2 \quad (1)$$

in which $\omega_c$ is the angular cutoff frequency of the transmission member 22, $\omega_p$ is the angular plasma frequency, c is the speed of light and $k=(2\pi)/\lambda$ is the wavenumber (in which $\lambda$ is the free-space wavelength of the incident microwave signal). The transmission member's angular cutoff frequency $\omega_c$ is a function of the physical parameters of the transmission member. In a rectangular waveguide, for example, in which the broad walls (walls 40 in FIGS. 1 and 2) have a dimension a, the angular cutoff frequency is $\omega_c \sim \pi c/a$ for a $TE_{10}$ propagation mode.

In contrast, the angular plasma frequency $\omega_p$ is basically a function of the plasma's electron density. It is given by $$\omega_p = \sqrt{\frac{Ne^2}{m\epsilon_0}} \tag{2}$$

in which N is electrons per unit volume, e and m are respectively electron charge and electron mass and $\epsilon_o$ is free space permittivity. Equation (1) can be rewritten as $$\omega^2 - (\omega_c^2 + \omega_p^2) = k^2 c^2. \tag{3}$$

Equation (3) states that a microwave signal with an angular frequency $\omega$ will propagate through the transmission member with a wavelength $\sim(2\ \pi c)/\omega$ if $\omega^2 >> (\omega_c^2 + \omega_p^2)$. However, as the angular plasma frequency $\omega_p$ is increased (by increasing the electron density N in equation (2)), the value of the left side of equation (3) decreases towards zero. Because c is constant, this means that the wavelength of the microwave signal 50 increases towards infinity so that signal propagation in the transmission member 22 ceases when $\omega = (\omega_c^2 + \omega_p^2)^{1/2}$.

The signal propagation through the switch 20 can also be written in terms of the microwave signal's propagation constant which can be expressed as $$E_x = e^{j\gamma z} \tag{4}$$

in which z is a space coordinate direction along the transmission member from the input port 26 to the output port 28, x is a coordinate direction which is orthogonal to z (e.g., parallel to the narrow sides 38 of the transmission member 22) and the signal propagation constant $\gamma$ is given by $$\gamma = \frac{\omega}{c}\sqrt{1 - \left(\frac{\omega_c^2 + \omega_p^2}{\omega^2}\right)}. \tag{5}$$

When the angular plasma frequency $\omega_p$ is sufficiently small so that the term $\omega_c^2 + \omega_p^2$ is less than the term $\omega^2$, the propagation constant is $\sim\omega/c$ and equation (4) becomes $$E_x = e^{j(\frac{\omega}{c})z}$$

which is the equation of a propagating signal along the z coordinate (it is now assumed that the angular cutoff frequency $\omega_c$ is much smaller than the angular microwave frequency $\omega$). In this case, the incident signal 50 is transmitted through the microwave switch 20 to the output port 28.

In contrast, when $\omega_p$ exceeds the angular frequency $\omega$ of the incident microwave signal 50 the propagation constant of equation (5) is imaginary and equation (4) becomes $$E_x = e^{-kz}$$

in which k is a constant. This is the equation of a signal which is attenuated as it progresses along the z coordinate. If $\omega_p$ is $>>\omega$, the constant k is large which indicates a rapid attenuation. Because the incident signal 50 is not transmitted, boundary conditions at the input port 26 require a second signal which travels oppositely to the incident signal, i.e., the incident signal 50 is reflected from the input port 26.

Thus, when the plasma angular frequency $\omega_p$ exceeds the angular frequency $\omega$ of the incident microwave signal 50 in FIGS. 1 and 2, the signal 50 will be reflected from the transmission member 22. In particular, it is reflected from the face 52 of the plasma which is directly behind the vacuum window 29 in FIG. 1 (the plasma face 52 is identical with the face of the ionizable gas 32). In contrast, when the angular plasma frequency $\omega_p$ is much less than the angular frequency $\omega$ of an incident microwave signal, the incident signal 50 will be transmitted through the transmission member 22 with little or no attenuation.

The triggered-plasma microwave switch 20 of FIGS. 1 and 2 is structured to control the generation of a trigger plasma within the chamber 30 and, by means of this control, selectively switch an incident microwave signal 50 at the input port 26 between transmission to the output port 28 and reflection from the input port 26.

In operation of the switch 20, a species of ionizable gas is selected. The gas 32 has an ionization energy $U_i$ and can be ionized with the triggered plasma generator 24 to generate a trigger density $N_t$ of seed electrons, i.e., generate a trigger plasma. The power of the incident signal 50 is selected to be in a power range $P_i$ where the electric field is sufficient to accelerate the seed electrons to an energy $E_e$ which equals or is greater than the ionization energy $U_i$. Finally, the pressure of the gas 32 is selected to be in a pressure range $\Delta Pr_g$ that enhances the process of further gas ionization by the incident signal 50.

If the gas pressure is below the pressure range $\Delta Pr_g$, the molecular population of the gas is so small that there is an absence of collisions with the accelerated seed electrons. If the gas pressure is above the pressure range $\Delta Pr_g$, the collision rate is so high that the seed electrons cannot be accelerated for a time sufficient to attain the energy $E_e$. When the gas pressure is in the range $\Delta P_g$, the seed electrons are accelerated to the energy $E_e$ and collisions are obtained between them and atoms of the gas 32. These collisions generate secondary electrons which are also accelerated to the energy $E_e$.

In this process, the electron population rapidly reaches a reflection density $N_r$ which, in accordance with equation (1), is sufficient to create a plasma frequency $\omega_p$ that is equal to or greater than the angular frequency $\omega$ of the incident signal 50. Accordingly, the incident signal is reflected from the input port 26. In particular, it is reflected from the face 52 of the plasma which is directly behind the vacuum window 29 in FIG. 1.

The production of secondary electrons is a self-limiting process. Because the incident signal 50 is reflected and does not reach inner portions of the chamber 30, the production of electrons ceases in such inner portions and the electron density drops below $N_r$. On the other hand, the incident signal 50 must achieve some penetration of the chamber 30 in order to generate the electron reflection density $N_r$ in some portion of the gas 32. As a consequence, the incident signal 50 is not reflected at the face 52 but from a thin volume of plasma that adjoins the face 52.

The electron reflection density $N_r$ is maintained as long as the incident signal 50 is present to continue production of secondary electrons. The triggered plasma generator 24 need only be activated long enough to generate the seed electrons in the gas 32. Once this has been accomplished, the seed generation of the triggered plasma generator 24 is preferably terminated, i.e., the triggered plasma generator 24 need only be pulsed to initiate the switching process. When the incident signal 50 is removed, the electron density quickly decays away, e.g., in <100 microseconds.

If the triggered plasma generator 24 is not activated, there are no seed electrons in the chamber 30 to be accelerated into collisions with gas atoms by the electric field of the incident signal 50. Although the electric field of the incident signal 50 can accelerate seed electrons to an energy $E_e$ which is sufficient to match the ionization energy $U_i$, the electric field is generally not sufficient to strip electrons off of gas atoms. Consequently, if seed electrons have not been generated by application of the triggered plasma generator 24, no plasma is generated by the incident signal 50 and it is transmitted to the output port 28.

Therefore, the triggered plasma generator 24 can be used to direct the incident signal 50 along selected signal paths. Activation of the triggered plasma generator 24 causes the incident signal 50 to follow a reflection path away from the plasma face 52. Non-activation of the triggered plasma generator 24 causes the incident signal 50 to follow a signal path through the transmission member 22 to the output port 28.

In operation of the triggered plasma generator 24, a high-voltage trigger pulse (e.g., in the range of 2–5 kV) is placed upon the electrode 36. As a result, a large current, e.g., ~50 amperes, is drawn through the electrode 36. It is theorized that a few stray electrons, which represent a density far less than the trigger density $N_t$, are always present in the ionizable gas because of natural processes, e.g., cosmic rays. These stray electrons are accelerated to the electrode 36 as indicated by the spiral path 56 of an exemplary electron in FIG. 2.

The thin configuration of the electrode 36 is selected to obtain a path length 56 which obtains sufficient collisions with gas atoms and consequent secondary electron production to produce the trigger density $N_t$ of seed electrons. The electrode 36 is particularly adapted for this function. Because of the small profile of the electrode, electron velocity typically causes an electron to initially miss the electrode. Accordingly, the electrons travel a longer path, e.g., the path 56, as they circle the electrode before finally reaching it. This enhances the production of seed electrons and produces the observed large current.

Although the electron density generated by the triggered plasma generator 24 may be quite large (even temporarily reaching the reflection density $N_r$), it need only reach the relatively small trigger density $N_t$ to initiate the rapid generation of secondary electrons by the incident signal 50.

Because the thin electrode 36 may be significantly heated by the trigger pulses, it is preferably formed of a refractory metal, e.g., tungsten. To increase the path length 56, the diameter of the electrode 36 is very small, e.g., <600 microns. Preferably, the electrode diameter is even less, e.g., ~250 microns, so as to further increase the path length 56 and further enhance secondary electron generation.

An exemplary prototype of the triggered-plasma microwave switch 20 has been fabricated. The prototype included a rectangular waveguide (a WR-650 guide per EIA Waveguide Designation Standard RS261A) as the transmission member 22. Hydrogen was selected as the gas species and a gas pressure of ~$1\times10^{-3}$ torr was selected. The prototype's triggered plasma generator employed an electrode (36 in FIGS. 1 and 2) which was a tungsten wire that had a diameter of ~250 microns. The power of the incident microwave frequency was selected to be approximately 20 kW.

Exemplary test results are shown in the graphs, 60, 62, 64 and 66 of FIGS. 5A–5D. The prototype was tested by applying a microwave signal having a pulse duration of ~100 microseconds, a frequency of ~1.25 GHz and a power of ~19.5 kW to the switch's input port (26 in FIGS. 1 and 2). This input microwave signal pulse is shown as the pulse 67 in graph 62. Because of test limitations, the pulse 67 had an initial power of ~19.5 kW and then drooped to a lower power level of ~9.7 kW for the remainder of the pulse 67.

The voltage of the trigger pulse on the electrode 36 was selected from a range of 2–5 kV. In the test shown in FIGS. 5A–5D, the seed electrons (which were attracted to the electrode by the trigger pulse) generated a current of ~50 amperes as indicated by the trigger pulse 69 in graph 60. The required trigger energy was <0.1 Joule. The trigger pulse was generated in a pulse generator 70 which is shown in schematic form in FIG. 2. The pulse generator 70 charged a capacitor 72 through a resistor 74 from a voltage source 76. A switch 78 coupled electrical energy from the capacitor 72 and through a current-limiting resistor 79 to the triggered plasma generator 24 of the switch. The current drawn by the electrode was sensed by a current sensor 81.

Figure 5A:
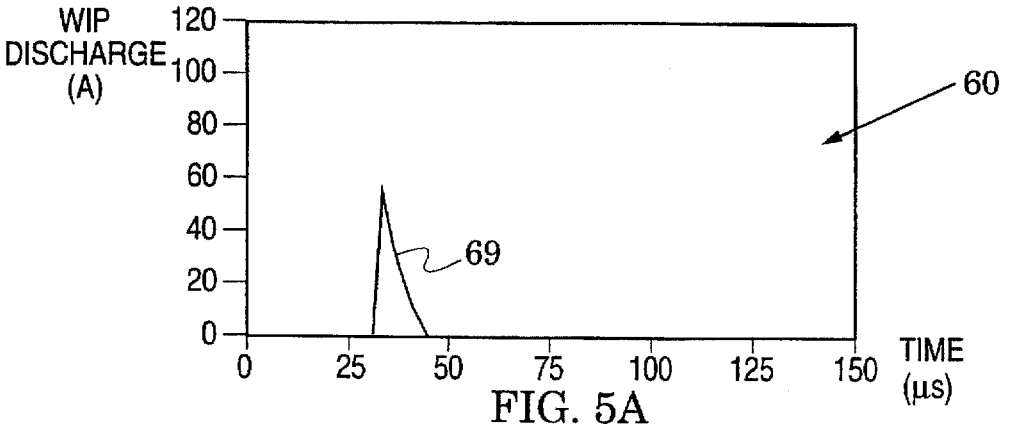
FIGS. 5A and 5B respectively illustrate a trigger pulse and an incident microwave signal which were applied to a prototype of the triggered-plasma microwave switch of FIG. 1.
Figure 5B:
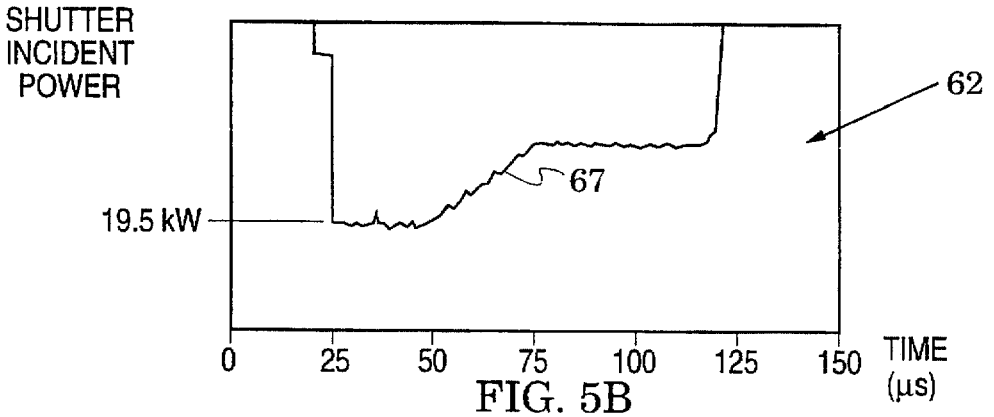
Figure 5C:
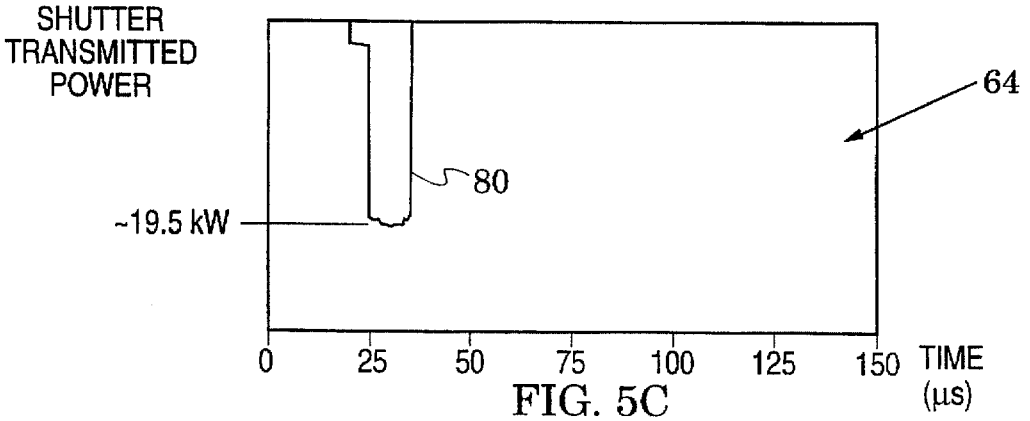
FIGS. 5C and 5D respectively illustrate transmitted and reflected microwave signals from a prototype of the triggered-plasma microwave switch of FIG. 1 in response to the trigger pulse and incident microwave signal of FIGS. 5A and 5B.
Figure 5D:
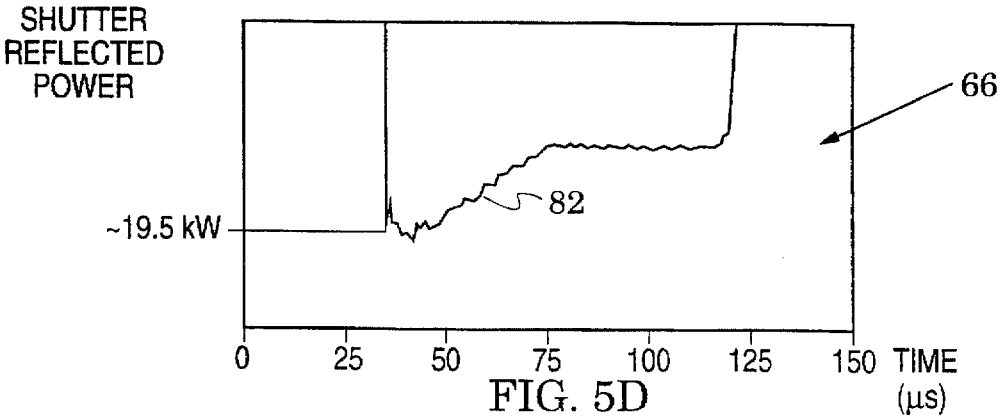

The power transmitted through the prototype switch is shown as the pulse 80 in FIG. 5C and the power reflected from the switch is shown as the pulse 82 in FIG. 5D. Prior to the application of the trigger pulse 69, the pulses 80 and 82 respectively illustrate transmission of the input pulse 67 through the switch and an absence of reflected power. After the application of the trigger pulse 69, the pulses 80 and 82 respectively illustrate an absence of transmitted power and reflection of the input pulse 67 from the switch.

The reflected power prior to the trigger pulse 69 and the transmitted power after the trigger pulse 69 were both less than the ~1 kW sensitivity of the test arrangement. The power transmitted through the switch after the trigger pulse 67 had an insertion loss of <1 dB. The reflected power after the trigger pulse had a return loss of ~0.4 dB (the power pulses 69, 80 and 82 appear to be upside down in graphs 62, 64 and 66 because the power detectors used in the test had a negative response). Because the prototype test required a low trigger energy (e.g., <0.1 Joule) and a rapid deionization of the gas and because the switch involves no moving parts, the prototype triggered-plasma microwave switch indicated that pulse rates>>100 Hz are realizable.

In the prototype tests of FIGS. 5A–5D, the trigger pulse was applied after the beginning of the pulse to demonstrate transmission and reflectance of the switch. In typical operation, the trigger pulse can be applied during the rising edge of the microwave signal pulse or during the signal pulse. Although it can also be applied prior to the pulse, the time to the microwave signal pulse must not exceed the deionization time of the ionizable gas, i.e., the trigger electron density $N_t$ must still be present when the microwave signal 50 arrives.

It was stated above that the power of the incident signal 50 is selected to be in a power range $P_i$ where the electric field is sufficient to accelerate the seed electrons to an energy $E_e$ which equals or is greater than the gas ionization energy $U_i$.

This range is dependent upon the selected gas species but, based upon prototype tests, it is thought that the lower limit of $P_i$ is on the order of 100 watts. The upper limit of $P_i$ is only set by the point where the electric field of an incident signal could strip electrons from gas atoms and thereby negate the switching control of the triggered plasma generator, e.g., the generator 24 of FIGS. 1 and 2. This limit is theorized to be well above 100 kilowatts.

It was also stated that the gas pressure must be above a pressure in which the molecular population of the gas is so small that there is an absence of collisions with the accelerated seed electrons. In contrast, the gas pressure must be below a pressure in which the collision rate is so high that the seed electrons cannot be accelerated for a time sufficient to attain the energy $E_e$. Although this range is somewhat dependent upon the selected gas species, it is theorized (with the aid of prototype tests) that the lower pressure limit is on the order of 0.1 millitorr and the upper pressure limit is on the order of 100 torr.

Figure 3:
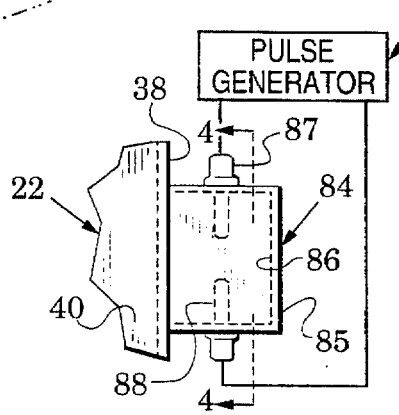
FIG. 3 is a plan view of a portion of the triggered-plasma switch of FIG. 2 in which a first triggered plasma generator embodiment has been replaced by a second triggered plasma generator embodiment.
Figure 4:
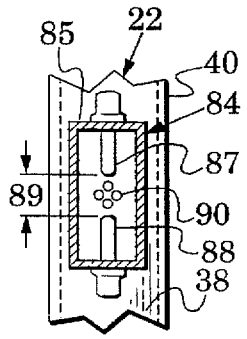
FIG. 4 is a view along the plane 4—4 of FIG. 3.

Other triggered-plasma switch embodiments can be formed with other triggered plasma generators. For example, FIGS. 3 and 4 illustrate a triggered plasma generator 84. The generator 84 replaces the generator 24 of FIGS. 1 and 2 and is preferably mounted on the same narrow wall 38 of the transmission member 22. The generator 84 includes a housing 85 which is connected to the narrow waveguide wall 38 to form a spark chamber 86.

A pair of electrodes 87 and 88 are mounted in the housing 85 to extend into the spark chamber 86. The electrodes 87 and 88 are arranged so that their ends are spaced by a spark gap 89. One or more apertures 90 are formed in the narrow wall 38 to provide communication between the spark chamber 86 and the waveguide chamber 30. These apertures 90 are preferably positioned in the narrow wall 38 to minimize perturbation of the electric field of the incident signal 50 which is typically between the broad walls 40 of the transmission member 22. The electrodes 87 and 88 are energized by a pulse generator 92. The pulse generator 92 can, for example, be the pulse generator 70 of FIG. 2 in which the leads 93 and 94 of the pulse generator 70 are connected to opposite ones of the electrodes 87 and 88.

In operation of the triggered plasma generator 84, application of a trigger voltage pulse, e.g., in the 2–5 kV range, creates a spark across the spark gap 89. Electromagnetic components of the spark are coupled through the apertures 90 to the waveguide chamber 30. Because photonic energy in these components increases as the wavelength decreases, some component portion, e.g., an ultraviolet portion, has sufficient energy to photoionize atoms in the gas 32. This photoionization generates the seed electrons which enable additional plasma production to occur in the waveguide chamber 30 when the electric field of the incident signal 50 is imposed across the broad walls 40 of the transmission member 22.

When the triggered plasma generator 84 is used, another gas selection parameter to be considered is the ultraviolet absorption length. This absorption length is preferably less than the dimensions of the waveguide chamber 30 and the gas species should be chosen accordingly, e.g., by possibly choosing an appropriate mixture of two gas species such as helium and argon.

Based upon prototype tests, the voltage range of the trigger pulse for application to the triggered plasma generator 24 of FIGS. 1 and 2 and the triggered plasma generator 84 of FIGS. 3 and 4 has a lower limit on the order of 1 kilovolt and an upper limit on the order of 10 kilovolts.

Figure 6:
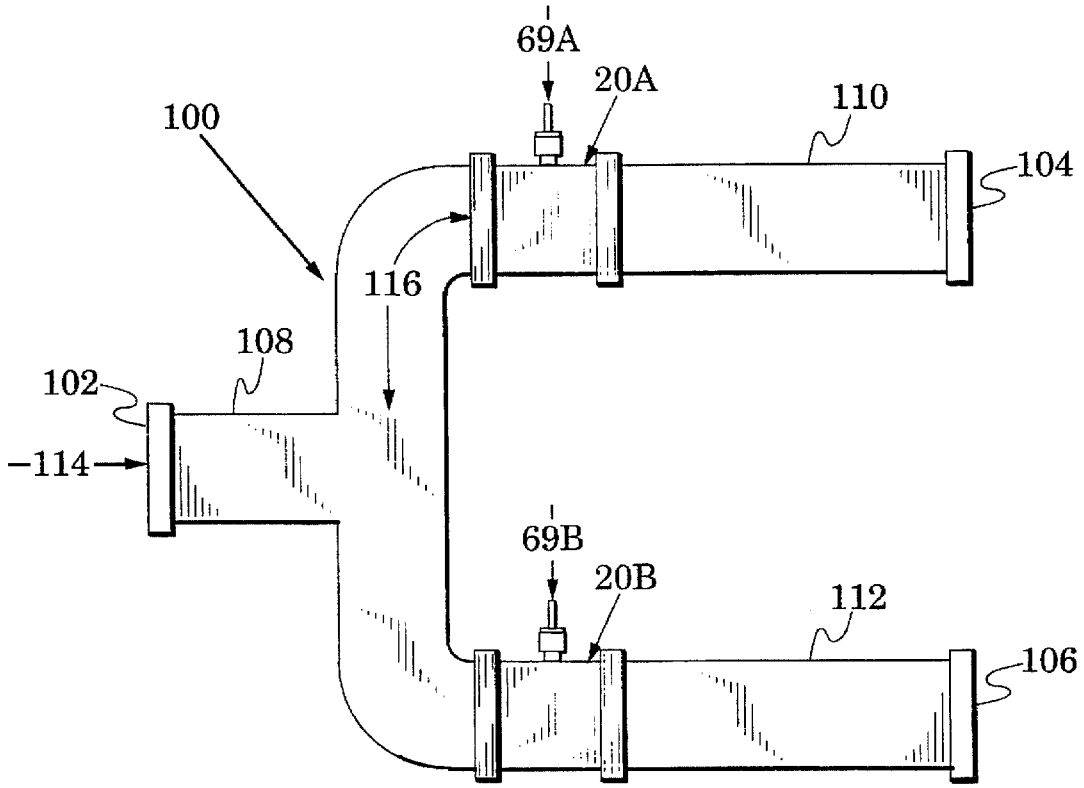
FIG. 6 is a plan view of a microwave switching system which includes the triggered-plasma microwave switch of FIG. 1.

The triggered-plasma microwave switch 20 of FIGS. 1 and 2 can be used to form various microwave systems. For example, FIG. 6 illustrates an exemplary switching system 100 which has a waveguide input port 102 and two waveguide output ports 104 and 106 that can feed separate microwave structures, e.g., two antennas. A waveguide arm 108 which leads from the input port 102 is coupled to two waveguide arms 110 and 112 which respectively lead to the output ports 104 and 106. A triggered-plasma microwave switch 20A is positioned in the waveguide arm 110 and another triggered-plasma microwave switch 20B is positioned in the waveguide arm 112. Trigger pulses 69A and 69B can be applied to the switches 20A and 20B as shown by arrows in FIG. 6.

As indicated by the prototype test results of FIGS. 5A–5D, a microwave input signal 114 at the input port 102 can be directed along selected paths to either of the ports 104 and 106, split between the ports 104 and 106, or reflected back to the input port 102.

For example, applying only the trigger pulse 69A would directed the input microwave signal 114 to the output port 106. If neither of the trigger pulses 69A and 69B is applied, the signal 114 will be split between the output ports 104 and 106. Applying both trigger pulses 69A and 69B will cause the signal 114 to be reflected from the input port 102.

The switching system 100 is preferably configured in accordance with conventional microwave practices. As an example, the path length 116 can be selected so that the signal reflected from the switch 20A is in phase with the input microwave signal that is traveling along the arm 112. Consequently, the signals are in phase and constructively add to form the microwave output signal at the output port 106.

Figure 7:
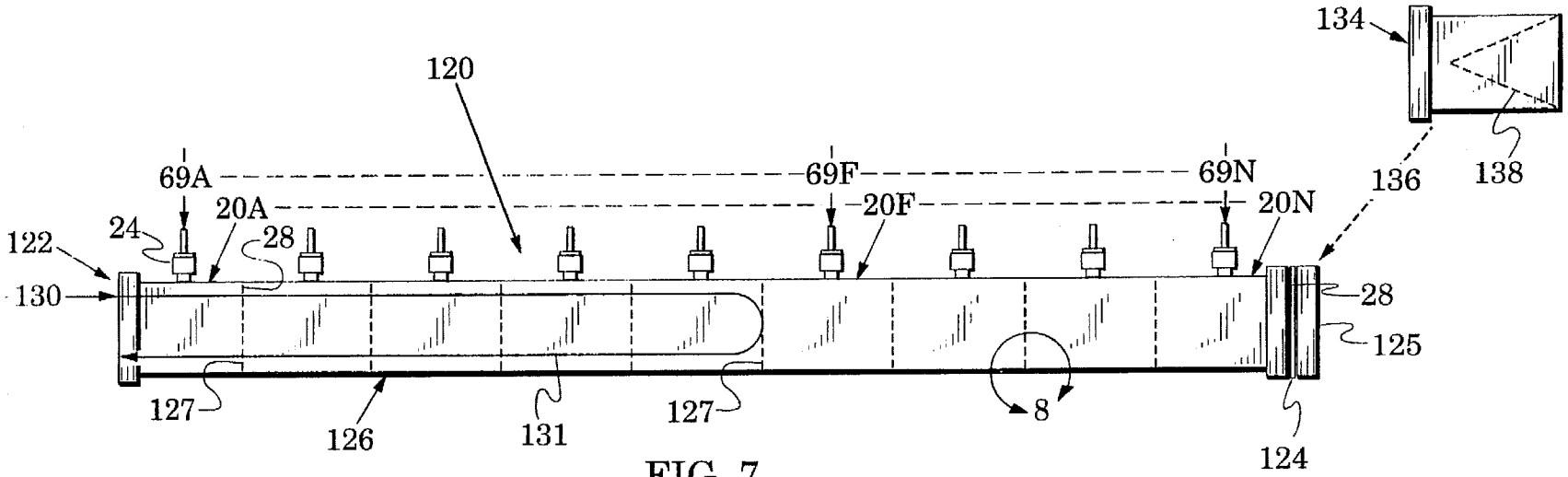
FIG. 7 is a side view of a tunable short which includes the triggered-plasma microwave switch of FIG. 1.

FIG. 7 illustrates the use of the triggered-plasma microwave switch 20 to construct another microwave switching system in the form of an electrically-tunable short 120. The electrically-tunable short 120 includes a plurality of microwave switches 20A–20N which are serially connected, e.g., the output port 28 of the microwave switch 20A is connected to the input port 26 of the switch which adjoins the switch 20A. The input port 26 of the microwave switch 20A forms an input port 122 of the electrically-adjustable short 120. The output port 28 of the microwave switch 20N is terminated with a mechanical short in the form of a metal shorting plate 124. The shorting plate 124 is attached with appropriate structure, e.g., a flange 125. Trigger signals 69A–69N can be applied respectively to the ionization generators 24 of the switches 20A–20N.

Each of the switches 20A–20N is essentially the switch 20 of FIGS. 1 and 2. However, because adjoining switches have output ports adjoining input ports, a single waveguide 126 can be used and the vacuum windows 29 and flanges 33 of FIG. 1 can be replaced at the adjoining ports with membranes 127 of a material (e.g., plastic, glass or ceramic) which transmits electromagnetic energy but which prevents plasma and ultraviolet light from moving between the switches 20A–20N. Although the membranes 127 prevent plasma flow between switches, they preferably permit the flow of ionizable gas between switches so that the electrically-tunable short 120 only has one gas chamber rather than a plurality of chambers. The membranes 127 essentially divide the gas within the tunable short 120 into gas compartments which are each associated with a different triggerable-plasma generator 24.

Figure 8:
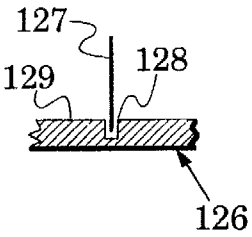
FIG. 8 is an enlarged view of the structure within the curved line 8 of FIG. 7.

This function can be achieved by receiving the membranes 127 into a reentrant structure such as the slot 128 in the wall 129 of the waveguide 126 as shown in FIG. 8. This reentrant structure permits gas atoms to pass between adjoining switches but blocks the passage of the plasma electrons and ions.

In operation of the tunable short 120, a microwave signal 130 is injected into the input port 122. A selected one of the trigger signals, e.g., trigger signal 69F, is applied to its associated microwave switch, e.g., the switch 20F, to generate an electron trigger density $N_r$ in that switch. Consequently, the microwave signal 130 is reflected back to the input port 122 from switch 20F. Therefore, the microwave signal 130 follows a signal path 131 from the input port 122 to the input port 26 of the switch 20F and back again to the input port 122.

Obviously, the length of the signal path 131 is successively lengthened as trigger signals 69A–69N are successively applied. Accordingly, the phase of the microwave signal 130 is successively increased when it returns to the input port 122, i.e., the electrically-tunable short 120 can be used to electrically select a desired signal phase of a return signal at its input port 122. The selectable phase steps have a phase resolution which is substantially determined by the signal's change in phase as it twice travels the length of one of the microwave switches 20A–20N. A final phase step is obtained if none of the trigger signals 69A–69N are applied. In that case, the input signal 130 is reflected from the metal shorting plate 124.

Another embodiment of the electrically-tunable short 120 can be formed by substituting a microwave load 134 for the metal shorting plate 124. This substitution is indicated in FIG. 7 by a broken-line arrow 136. The microwave load 134 contains a conventional microwave-absorbent material 138 which substantially absorbs incident microwave signals. This embodiment of the electrically-tunable short 120 can be used as either an electrically-tunable short or (in the absence of trigger signals) an absorbent load.

Another embodiment of the electrically-tunable short 120 can be formed by omitting the metal shorting plate 124. This embodiment of the electrically-tunable short 120 can be used as either an electrically-tunable short or (in the absence of trigger signals) a transmission member.

Figure 9:
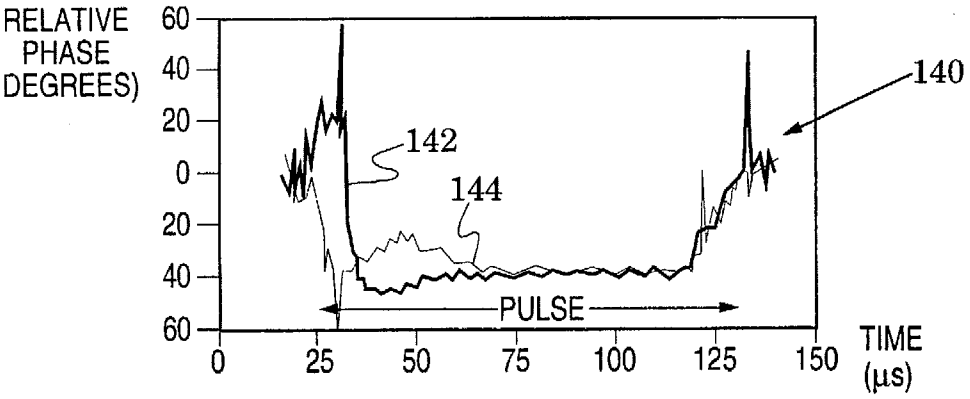
FIG. 9 is a graph of measured phase stability in a prototype of the tunable short of FIG. 7.

A phase stability test was performed on an exemplary prototype of the triggered-plasma microwave switch 20 which is used in the electrically-tunable short 120. A microwave pulse having a pulse width of substantially 100 microseconds was reflected for the input port of the switch. The relative phase of the reflected pulse is shown as the wide-line plot 142 in the graph 140 of FIG. 9. For comparison, a microwave pulse was reflected from a metal shorting plate similar to the plate 124 in FIG. 7. The relative phase of the reflected pulse from the shorting plate is shown by the narrow-line plot 144 in the graph 140 of FIG. 9. This test confirmed that the phase stability of signals reflected from the triggered-plasma switch 20 substantially equals the phase stability of signals reflected from conventional shorting plates.

The absolute phase change effected by a triggered-plasma switch 20 is not the same as that effected by a shorting plate 124 which is located at the same position as the plasma face (52 in FIG. 1) of the switch 20. As described above, an incident signal is not reflected at the face 52 but from a thin volume of plasma that adjoins the face 52.

Figure 10:
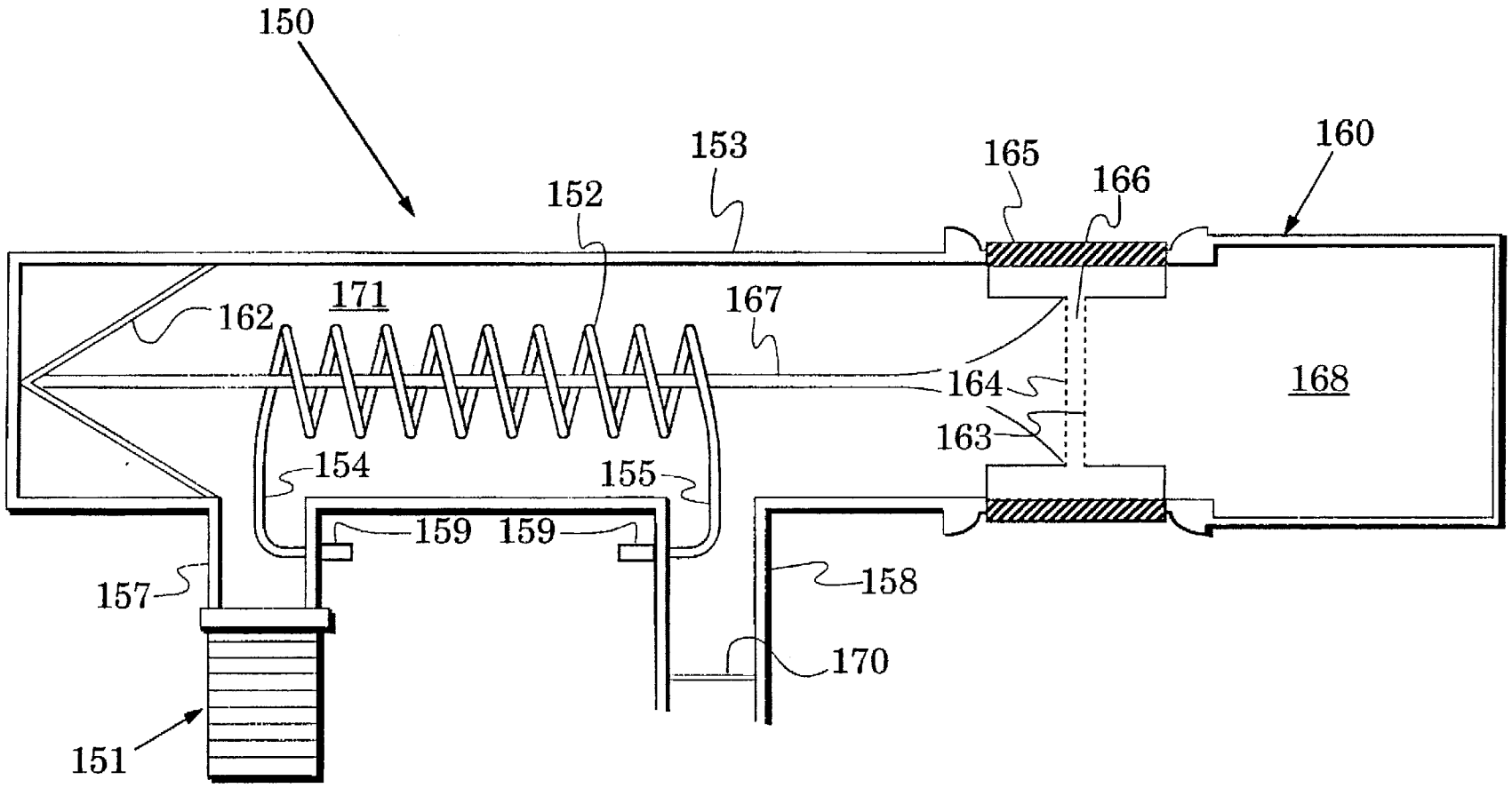
FIG. 10 is a side view of a plasma-assisted microwave oscillator which incorporates the tunable short of FIG. 7.

An electrically-tunable short has a variety of microwave applications. For example, FIG. 10 illustrates a plasma-assisted microwave oscillator 150 which includes an electrically-tunable short 151 which is similar to the electrically-tunable short 120 of FIG. 7. The plasma-assisted oscillator 150 is similar to oscillator structures described in U.S. patent application Ser. No. 08/242,570 which was filed May 13, 1994 and assigned to Hughes Aircraft Company, the assignee of the present invention.

The oscillator 150 has a slow-wave structure in the form of a helix 152 that is positioned in a waveguide housing 153. The ends 154 and 155 of the helix 152 are electromagnetically coupled respectively to a reflection waveguide 157 and output waveguide 158. These waveguides are orthogonally arranged with the housing 153. The helix ends 154 and 155 are also passed through walls of the waveguides 157 and 158 to terminate in cooling ports 159 which facilitate the passage of coolant through the helix 152.

A plasma-cathode electron gun 160 is mounted one end of the housing 153 and a beam collector 162 is positioned at the other housing end. The electron gun 160 includes grids 163 and 164 which are supported on an insulator 165. Voltage applied across the grids 163 and 164 create an acceleration region 166 that extracts an electron beam 167 from a plasma 168 in the plasma-cathode electron gun. The electrically-tunable short 151 is positioned to terminate the reflection waveguide 157 and a vacuum window 170 is positioned across the output waveguide 158.

In operation, the housing 153 is filled with an ionizable gas 171 and the electron beam 167 is injected through the helix 153 by the plasma-cathode electron gun 160. The beam 167 is confined and transported through the helix 152 without the aid of conventional magnetic focusing structures because the beam's negative space charge is neutralized by a plasma channel that is created in the bas 171 by the electrons of the beam 167. Energy is coupled from the electron beam 167 to microwave energy which grows along the helix 152 and is coupled from the helix end 155 by the output waveguide 158. The electron beam's remaining energy is dissipated in the collector 162.

Prototypes of the plasma-assisted microwave oscillator 150 have generated high power pulses, e.g., >20 kW with a pulse width of ~100 microseconds. It has been shown in experiments that the power at the output waveguide 158 is a function of the location of an electric short in the reflection waveguide 157. To obtain a selected output power at the output waveguide 158, microwave energy must be reflected from the short with a corresponding phase. In one test, for example, the output power varied over a 3 db range as a shorting plate was mechanically moved in the reflecting waveguide 157 to effect the required phase change.

Adjustment of a mechanical short is a labor and time intensive operation. The electrically-tunable short 151 performs the same function but facilitates rapid adjustment. The electrically-tunable short 151 facilitates the selection of a different reflected phase for each microwave pulse from the plasma-assisted microwave oscillator 150. This function can be used, for example, in frequency-agile oscillators. As the oscillator's frequency is changed between pulses, the electrically-tunable short 151 can be programmed to maintain substantially constant output power or, alternatively, to select a different power for adjacent pulses.

Triggered-plasma switches of the present invention are especially suited for controlling the propagation path of high-power microwave signals. Compared to conventional microwave switches, they are simple, inexpensive, switch rapidly (e.g., <5 microseconds), can be switched at a high rate (e.g., >>100 Hz) and require only a low-energy trigger pulse (e.g., <0.1 Joule).

They exhibit a low insertion loss in a transmission state and high phase stability in a reflection state. In contrast to many conventional microwave switches, the switches of the invention do not include parts which are consumed by the switching process, e.g., the electrode 36 of FIGS. 1 and 2 and the electrodes 87 and 88 of FIGS. 3 and 4 carry an electrical current but do not contribute material during plasma generation. This reduces the deposition of material on vacuum windows that causes performance deterioration in conventional microwave switches.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A method for selectively directing a microwave signal along first and second signal paths, comprising the steps of:

providing an ionizable gas of a selected species;

adjusting the pressure of said gas so that the incidence of a microwave signal will generate from seed electrons in said gas a plasma having a reflecting electron density $N_r$ that is sufficient to reflect said microwave signal from said plasma;

causing said microwave signal to be incident upon said gas; and selectively applying an electric potential to an electrode which protrudes into said gas to direct said microwave signal along a first signal path away from said plasma or omitting said applying of an electric potential to direct said microwave signal along a second signal path through said gas.

2. The method of claim 1, wherein said applying step includes the step of limiting the diameter of said electrode to less than 600 microns.

3. The method of claim 1, wherein said adjusting step includes the step of selecting said gas pressure above a lower limit at which there is an insufficient molecular density in said gas for said seed electrons to collide with and form said reflecting electron density $N_r$.

4. The method of claim 1, wherein said adjusting step includes the step of selecting the pressure of said gas below an upper limit at which the molecular density of said gas is so great that said seed electrons cannot be sufficiently accelerated to form said reflecting electron density $N_r$ by collisions with molecules of said gas.

5. The method of claim 1, wherein said gas pressure is between 0.1 millitorr and 100 torr.

6. The method of claim 1, wherein said gas pressure is substantially $1\times10^{-3}$ torr.

7. The method of claim 1, wherein said gas species is hydrogen.

8. The method of claim 1, wherein said gas species is a mixture of helium and argon.

9. A method for selectively directing a microwave signal along first and second signal paths, comprising the steps of:

providing an ionizable gas of a selected species;

adjusting the pressure of said gas so that the incidence of a microwave signal will generate from seed electrons in said gas a plasma having a reflecting electron density $N_r$ that is sufficient to reflect said microwave signal from said plasma;

causing said microwave signal to be incident upon said gas; and selectively directing ultraviolet light into said gas to direct said microwave signal along a first signal path away from said plasma or omitting said directing of ultraviolet light to direct said microwave signal along a second signal path through said gas.

10. The method of claim 7, wherein said adjusting step includes the step of selecting said gas pressure above a lower limit at which there is an insufficient molecular density in said gas for said seed electrons to collide with and form said reflecting electron density $N_r$.

11. The method of claim 9, wherein said adjusting step includes the step of selecting the pressure of said gas below an upper limit at which the molecular density of said gas is so great that said seed electrons cannot be sufficiently accelerated to form said reflecting electron density $N_r$ by collisions with molecules of said gas.

12. The method of claim 9, wherein said gas pressure is between 0.1 millitorr and 100 torr.

13. The method of claim 9, wherein said gas pressure is substantially $1\times10^{-3}$ torr.

14. The method of claim 9, wherein said gas species is hydrogen.

15. The method of claim 9, wherein said gas species is a mixture of helium and argon.

16. A method for obtaining a selected phase of a microwave signal, comprising the steps of:

providing an ionizable gas of a selected species;

selecting a pressure of said gas so that the incidence of a microwave signal will generate from seed electrons in said gas a plasma having a reflecting electron density $N_r$ that is sufficient to reflect said microwave signal from said plasma;

dividing said gas into a plurality of gas compartments which are serially connected between an initial gas compartment and a final gas compartment so that said initial gas compartment has a different path length from each of the other said gas compartments;

causing said microwave signal to be incident upon said initial gas compartment; and generating seed electrons in a selected one of said gas compartments to reflect said microwave signal along a selected signal path from that gas compartment to said initial gas compartment with a phase which is associated with said selected signal path.

17. The method of claim 16, wherein said generating step includes the step of applying an electric potential to an electrode which protrudes into said gas.

18. The method of claim 17, wherein said applying step includes the step of limiting the diameter of said electrode to less than 600 microns.

19. The method of claim 16, wherein said generating step includes the step of directing ultraviolet light into said gas to achieve said generation of seed electrons by photoionization.

20. The method of claim 16, wherein said adjusting step includes the step of selecting said gas pressure above a lower limit at which there is an insufficient molecular density in said gas for said seed electrons to collide with and form said reflecting electron density $N_r$.

21. The method of claim 16, wherein said adjusting step includes the step of selecting the pressure of said gas below an upper limit at which the molecular density of said gas is so great that said seed electrons cannot be sufficiently accelerated to form said reflecting electron density $N_r$ by collisions with molecules of said gas.

22. The method of claim 16, wherein said gas pressure is between 0.1 millitorr and 100 torr.

23. The method of claim 16, wherein said gas pressure is substantially $1\times10^{-3}$ torr.

24. The method of claim 16, wherein said gas species is hydrogen.

25. The method of claim 16, wherein said gas species is a mixture of helium and argon.

26. A triggerable microwave switch for selectively directing a microwave signal along first and second signal paths, comprising:

a microwave transmission member;

a microwave chamber formed by said transmission member for containing an ionizable gas;

input and output ports formed by said transmission member to communicate with said microwave chamber; and an electrode extending into said microwave chamber and arranged to receive a voltage trigger signal to generate a trigger electron density $N_t$ in said gas;

said microwave signal reflected along a first path from said input port when said trigger electron density $N_t$ is present and directed along a second path to said output port when said trigger electron density $N_t$ is absent.

27. The triggerable microwave switch of claim 26, wherein said electrode comprises a refractory metal and has a diameter<600 microns.

28. The triggerable microwave switch of claim 27, wherein said refractory metal is tungsten.

29. A triggerable microwave switch for selectively directing a microwave signal along first and second signal paths, comprising:

a microwave transmission member;

a microwave chamber formed by said transmission member for containing an ionizable gas;

input and output ports formed by said transmission member to communicate with said microwave chamber; and an ultraviolet-radiation generator which is arranged to direct, in response to a trigger signal, ultraviolet radiation into said chamber for photoionization of said gas and consequent generation of a trigger electron density $N_t$;

said microwave signal reflected along a first path from said input port when said trigger electron density $N_t$ is present and directed along a second path to said output port when said trigger electron density $N_t$ is absent.

30. The triggerable microwave switch of claim 29, wherein said ultraviolet-radiation generator includes;

a housing which forms an arc chamber;

at least one aperture in said transmission member to facilitate communication between said microwave chamber and said arc chamber; and a pair of spaced electrodes positioned within said arc chamber to receive said voltage trigger signal and generate an arc which contains ultraviolet radiation.

31. A tunable short, comprising:

a plurality of microwave switches, each of said switches having an input port and an output port and configured to selectively reflect a microwave signal from its input port and to transmit said microwave signal from its input port to its output port in response to a trigger signal; and an entrance port formed by the input port of a first one of said switches with said switches connected in series so that the input ports of the other switches are each spaced by a different path length from said first switch;

wherein each of said microwave switches includes:

a) a microwave transmission member;

b) a microwave chamber formed by said transmission member for containing an ionizable gas and said input and output ports are formed by said transmission member to communicate with said microwave chamber; and c) a triggered plasma generator configured to generate, in response to said trigger signal, a trigger electron density $N_t$ in said gas;

so that a microwave signal is reflected along a first path from said input port when said trigger electron density $N_t$ is present and directed along a second path to said output port when said trigger electron density $N_t$ is absent;

selective application of a trigger signal to different ones of said switches causing a microwave signal received at said entrance port to travel different path lengths as it is reflected back to said entrance port.

32. The tunable short of claim 31, wherein said triggered plasma generator includes an electrode extending into said microwave chamber and arranged to receive said voltage trigger signal.

33. The tunable short of claim 32, wherein said electrode comprises a refractory metal and has a diameter<600 microns.

34. The tunable short of claim 33, wherein said refractory metal is tungsten.

35. The tunable short of claim 31, wherein said triggered plasma generator is configured to direct ultraviolet radiation generator into said chamber for photoionization of said gas.

36. The tunable short of claim 35, wherein said triggered plasma generator includes;

a housing which forms an arc chamber;

at least one aperture in said transmission member to facilitate communication between said microwave chamber and said arc chamber; and a pair of spaced electrodes positioned within said arc chamber to receive said voltage trigger signal and generate an arc which contains ultraviolet radiation.

* * * * *